United States Patent [19]

Müller

[11] 4,085,927

[45] Apr. 25, 1978

[54] APPARATUS FOR GATHERING FOLDED SHEETS IN BOOKBINDING MACHINES

[75] Inventor: Hans Müller, Zofingen, Switzerland

[73] Assignee: Grapha-Holding AG, Hergiswil, Switzerland

[21] Appl. No.: 735,975

[22] Filed: Oct. 27, 1976

[30] Foreign Application Priority Data

Nov. 14, 1975 Switzerland ..... 14763/75

[51] Int. Cl.[2] ..... B65H 39/02

[52] U.S. Cl. ..... 270/54

[58] Field of Search ..... 270/54–56, 270/58

[56] References Cited

U.S. PATENT DOCUMENTS

| | | | |
|---|---|---|---|
| 2,845,264 | 7/1958 | Faeber | 270/54 |
| 3,412,994 | 11/1968 | Dutro | 270/54 |
| 3,547,429 | 12/1970 | Hepp | 270/54 |

FOREIGN PATENT DOCUMENTS

| | | | |
|---|---|---|---|
| 148,782 | 10/1931 | Switzerland | 270/54 |

*Primary Examiner*—Edgar S. Burr
*Assistant Examiner*—A. Heinz
*Attorney, Agent, or Firm*—Peter K. Kontler

[57] ABSTRACT

A gathering apparatus for folded sheets which are stored in several magazines at a level above the upper reach of an endless chain conveyor has suction heads which withdraw the folded backs of sheets from the respective magazines, rotary transfer members which complete the withdrawal of sheets from the respective magazines, pairs of rotary spreading members which open each withdrawn sheet at a level above the upper reach of the conveyor in such orientation that the front edge portions of the opened sheet are located at a level below the folded back of the sheet, and stationary guide members which flank the upper reach of the conveyor and guide the front edge portions of sheets during downward movement of sheets from the range of the respective spreading members toward the upper reach of the conveyor. The downward movement of sheets is promoted by nozzles which discharge air streams downwardly toward the outer sides of opened sheets and are preferably mounted in the guide members. Additional nozzles are mounted between successive magazines to discharge air streams which prevent shifting, lifting or other stray movements of sheets relative to the upper reach of the conveyor.

14 Claims, 2 Drawing Figures

6
3
2A
1
16
2a
122,123
20
3
4
18,12
19
1
7
II
II
22
5
6a
16
7
6
9
18
2

APPARATUS FOR GATHERING FOLDED SHEETS IN BOOKBINDING MACHINES

BACKGROUND OF THE INVENTION

The present invention relates to bookbinding machines in general, and more particularly to improvements in apparatus for gathering folded sheets or groups of folded sheets in bookbinding machines. Still more particularly, the invention relates to improvements in those units of sheet gathering apparatus which effect the delivery of folded sheets or groups of folded sheets from discrete magazines (e.g., pockets or bins) onto an endless conveyor which transports piles of gathered sheets to one or more further processing stations.

Presently known gathering apparatus comprise an endless conveyor which has an upper reach advancing along a substantially horizontal path past several delivery stations at each of which the upper reach receives a different folded sheet or group of folded sheets. Identical folded sheets or groups of folded sheets are stored in the aforementioned magazines, and each delivery station accommodates a withdrawing device which removes the lowermost sheet or lowermost group of sheets from the stack in the respective magazine and means for spreading or opening the leaves of the sheet or group of sheets prior to actual descent of sheets or groups of sheets onto the upper reach of the conveyor. As a rule, the spreading means deposit folded but opened sheets or groups of folded but opened sheets onto blade-like intercepting members, and the conveyor has entraining elements or pushers which transfer the sheets from the intercepting members onto the upper reach of the conveyor.

A drawback of the just described gathering apparatus is that folded sheets or groups of folded sheets are not guided during movement from the range of spreading means onto the corresponding intercepting members. This presents problems when the conveyor is driven at a relatively high speed because the position and/or orientation of sheets can deviate from an optimum position and/or orientation at the time they are engaged and entrained by the oncoming pushers. For example, the descent of sheets can be too slow so that they are not entrained by the oncoming pushers. Moreover, the sheets are likely to change their position on the upper reach if the conveyor is driven at a relatively high speed.

SUMMARY OF THE INVENTION

An object of the invention is to provide a sheet gathering apparatus which can accumulate piles of different folded sheets at a speed greatly exceeding the speed of accumulation of such piles in conventional gathering apparatus.

Another object of the invention is to provide a gathering apparatus wherein the delivery of sheets from the respective magazines onto the conveyor can be effected with a higher degree of reproducibility than in heretofore known apparatus in spite of the fact that the sheets can be gathered at an elevated speed.

A further object of the invention is to provide the gathering apparatus with novel and improved means for effecting the delivery of folded sheets from the respective magazines onto the conveyor.

An additional object of the invention is to provide the gathering apparatus with novel and improved means for preventing shifting or other stray movements of sheets on the conveyor.

A further object of the invention is to provide the gathering apparatus with novel and improved means for compacting or condensing the piles of sheets on the conveyor.

An ancillary object of the invention is to provide the gathering apparatus with means which insure that each entraining element or pusher of the conveyor invariably encounters a folded sheet during movement past each and every magazine.

The invention is embodied in an apparatus for gathering folded sheets of the type having a folded back and two front edge portions opposite the back. The apparatus comprises a conveyor (e.g., an endless chain conveyor) having an elongated portion (preferably the upper reach of the chain conveyor) moving in a predetermined direction along a predetermined (preferably horizontal) path, a plurality of magazines which are adjacent to the conveyor or portion and are spaced apart from each other, as considered in the direction of movement of the conveyor portion (the magazines are preferably mounted in or on discrete frames at a level above the conveyor portion and each magazine stores a supply or stack of folded sheets), and discrete means for delivering sheets from each magazine to the conveyor portion. Each delivering means includes a suction head and a rotary transfer member or analogous means for withdrawing sheets seriatim from the respective magazine in such orientation that the back of each withdrawn sheet is located at a level above the respective front edge portions and above the conveyor portion, spreading means (preferably including two rotary spreading or opening members which are driven to rotate in opposite directions and are disposed at the opposite sides of and at a level above the conveyor portion) for opening each withdrawn sheet by temporarily engaging the front edge portions and by moving the thus engaged front edge portions downwardly and away from each other, and means for guiding the opened sheet intermediate the spreading means and the conveyor portion. The guide means includes first and second guide members which are disposed at the opposite sides of the conveyor portion and have guide faces for the respective front edge portions of the opened sheet.

Each delivering means preferably further comprises means for promoting the downward movement of opened sheets onto the conveyor portion. Such means preferably includes nozzles or analogous devices for discharging downwardly directed streams of air or another gaseous fluid against the outer sides of successive opened sheets not later than while the egde portions of the sheets travel along the respective guide faces. The streams of gaseous fluid accelerate the opened sheets as soon as their front edge portions advance beyond the respective guide faces so that the descent of sheets onto the conveyor portion (or onto the customary intercepting members which are associated with each magazine) takes up very short intervals of time.

The apparatus preferably further comprises means for biasing the sheets against the conveyor portion during travel between successive delivering means. Such biasing means may include additional nozzles which discharge streams of air or another gaseous medium against the upper sides of sheets on the conveyor portion to thus prevent fluttering, lifting or shifting of sheets relative to the conveyor portion and/or the sheets therebelow.

The novel features which are considered as characteristic of the invention are set forth in particular in the appended claims. The improved gathering apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENT

Figure 1:
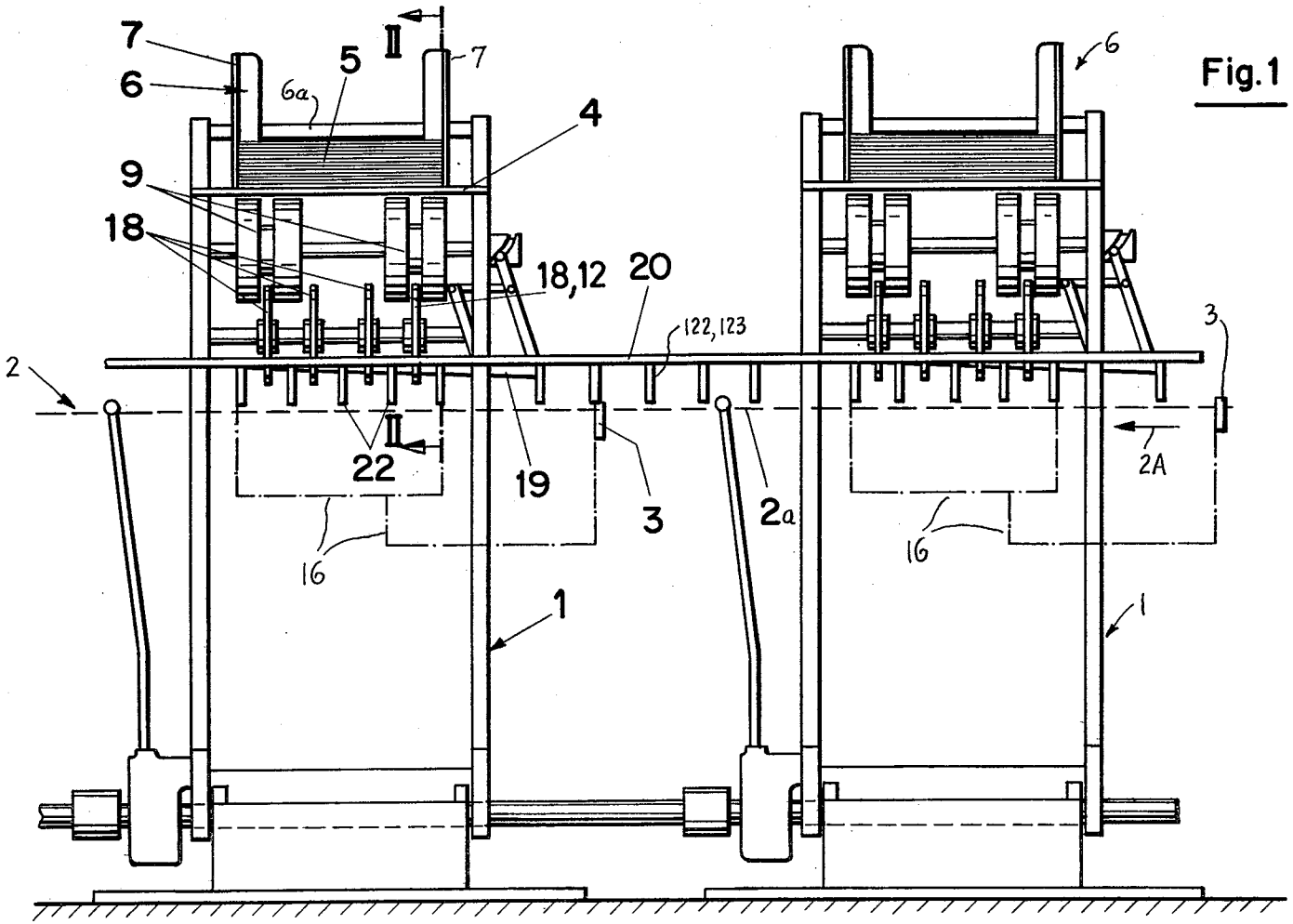
FIG. 1 is a fragmentary elevational view of a gathering apparatus which embodies the invention.

FIG. 1 shows a portion of a gathering apparatus which embodies the invention. The apparatus comprises an endless chain conveyor 2 having an enlongated horizontal upper portion or reach 2*a* which is driven to move in a direction from the right to the left, as viewed in FIG. 1 (see the arrow 2A). The entraining members or pushers on the upper reach 2*a* are shown at 3. The upper reach 2*a* travels at a level below a row of spaced-apart magazines 6 (only two shown in FIG. 1) each of which contains a stack or supply 5 of folded sheets 16 (see FIG. 2). Each magazine 6 is installed in a discrete frame 1 which further supports means for delivering successive folded sheets 16 from each magazine 6 to the upper reach 2*a*. Each delivering means comprises means for withdrawing sheets 16 from the respective magazine and means for spreading the withdrawn sheets prior to allowing the sheets to descend onto the upper reach 2*a* of the conveyor 2. Presently known delivering means are disclosed in Swiss Pat. Nos. 527,754, 493,337, 408,065 and 412,795. An endless chain conveyor which can be used in the gathering apparatus of the present invention is disclosed, for example, in Swiss Pat. No. 535,696.

Each magazine 6 has a substantially horizontal base plate or bottom 4 which has an outlet opening 4' evacuation of successive lowermost folded sheets 16. The sheets 16 are stacked in such a way that their folded backs 16*a* abut against a first side wall 6*a* and that their top and foot edges abut against additional side walls 7 of the respective magazine 6.

Figure 2:
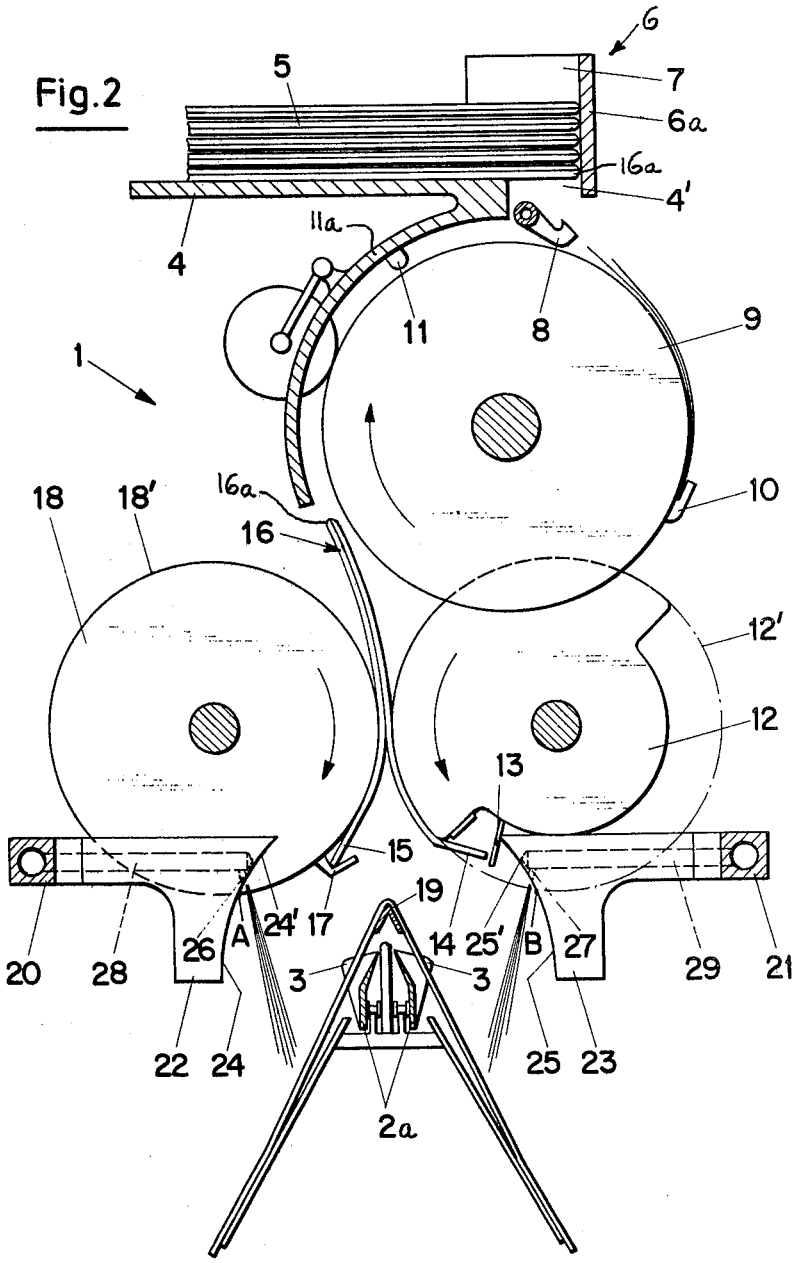
FIG. 2 is an enlarged fragmentary transverse vertical sectional view as seen in the direction of arrows from the line II—II of FIG. 1.

The means for withdrawing successive sheets 16 from a magazine 6 comprises at least one oscillatable suction head 8 which can move from the position of FIG. 2 to a second or raised position in which it abuts against and attracts the underside of the lowermost folded sheet 16 in a region close to the side wall 6*a*. The suction head 8 is thereupon pivoted clockwise, i.e., back to the position shown in FIG. 2, to thereby place the folded back 16*a* of the partially withdrawn sheet 16 into the range of a gripper or jaw 10 on a rotary transfer member 9 which is driven clockwise, as viewed in FIG. 2, and constitutes the second component of the respective withdrawing means. The gripper 10 is open when it approaches the back 16*a* of the partially evacuated sheet 16 and thereupon closes to advance the sheet clockwise, as viewed in FIG. 2. The gripper 10 opens when it (or the back 16*a* of the respective sheet 16) reaches an abutment 11 in an arcuate gap between the periphery of the transfer member 9 and a stationary shroud 11*a*. This enables the sheet 16 to become separated from the transfer member 9 which moves its gripper 10 toward the suction head 8 in order to engage the back 16*a* of the next-following sheet 16. The right-hand front edge portion 14 of the folded sheet 16 which has been released by the gripper 10 is immediately engaged and entrained by a clamping or engaging device 13 at the periphery of a rotary spreading member 12 which is driven to rotate in a counterclockwise direction, as viewed in FIG. 2, and pulls the sheet 16 into the nip between its cylindrical peripheral surface 12' and the cylindrical peripheral surface 18' of a second rotary spreading member 18. The spreading member 18 is driven to rotate in a clockwise direction, as viewed in FIG. 2. A clamping or engaging device 17 at the periphery of the spreading member 18 engages the left-hand front edge portion 15 of the sheet 16 so that the front edge portions 14, 15 are caused to move apart during transport of the respective sheet 16 downwardly toward the upper reach 2*a* of the conveyor 2. The clamping devices 13, 17 automatically release the respective front edge portions 14, 15 when the sheet 16 is sufficiently open to insure its descent onto a blade-like (inverted V-shaped) stationary intercepting member 19 therebelow. The manner in which the gripper 10 opens and closes and in which the clamping devices 13 and 17 engage and release the respective front edge portions 14, 15 of the sheets 16 is known, e.g., from the disclosures of the aforementioned Swiss patents. Once a sheet 16 descends onto and its back 16*a* rides on the respective intercepting member 19, its trailing edge is engaged by the oncoming pusher 3 of the upper reach 2*a* so that the sheet is stripped off the intercepting member 19 and begins to advance with the conveyor 2 toward the next-following frame 1. The spreading members 12, 18 at the transfer station of such next-following frame 1 deliver a different sheet 16 which comes to rest on the sheet therebelow so that the conveyor gradually assembles a substantially V-shaped pile of overlapping sheets 16 which is ready for transfer to a further processing station.

The problem of insuring reproducible delivery of successive folded sheets 16 from each magazine 6 onto the respective intercepting member 19 (i.e., onto the upper reach 2*a* of the conveyor 2) is solved in the following way: Each frame 1 supports or is adjacent to at least one guide member 22 at one side and at least one guide member 23 at the other side of the upper reach 2*a* of the conveyor 2. The guide members 22, 23 are respectively mounted below the spreading members 18, 12. FIG. 1 shows that each frame 1 supports or is adjacent to an entire battery or row of aligned guide members 22 and 23. FIG. 1 further shows that each spreading member 18 may consist of several coaxial disks and that each transfer member 9 may consist of two coaxial drums or rollers. Each spreading member 12 may comprise several disks which alternate with the disks of the associated spreading member 18.

The guide members 22, 23 are hollow and are respectively connected to discharge ends of elongated pipes of conduits 20, 21 which supply a compressed fluid (preferably air) from a suitable source, e.g., a blower (not shown). The conduits 20, 21 respectively discharge compressed air into channels 28, 29 which are machined into the corresponding guide members 22, 23 and communicate with the downwardly inclined orifices of nozzles 26, 27 serving to discharge air streams against the respective outer sides of an opened-up sheet 16 which is about to descend from the nip of the spreading members 12, 18 onto the intercepting member 19 therebelow. The guide members 22, 23 are respectively formed with suitably configurated (preferably concave) guide faces 24, 25 against which the front edge portions 15, 14 abut and along which such edge portions slide during travel in a direction toward the intercepting member 19. The distance between the major portions of the guide faces 24, 25 increases in a direction toward the upper reach 2*a*. The upper portions 24', 25' of the guide faces 24, 25 respectively extend into spaces between the neighboring components of the spreading members 18, 12 so that they are invariably engaged by the oncoming edge portions 15, 14 while the respective sheet 16 advances through the nip of the spreading members 12, 18. The locations where the edge portions 15, 14 are respectively likely to come into contact with the guide faces 24, 25 are indicated by the characters A and B. The orifices of the nozzles 26, 27 respectively extend inwardly and upwardly from the upper portions 24', 25' of the guide faces 24, 25. It will be noted that the distance between the lower portions of guide faces 24, 25 of two associated guide members 22, 23 is substantially constant; such distance corresponds to or approximates the desired or optimum distance between the front edge portions 14, 15 of a sheet 16 which is in the process of descending onto the adjacent intercepting member 19. Those (lower) portions of the guide faces 24, 25 which are located at a substantially constant distance from each other are disposed at the level of the upper reach 2*a* of the conveyor 2.

The operation is as follows:

When the suction head 8 withdraws the back 16*a* of a folded sheet 16 from the respective magazine 6, the back 16*a* is engaged by the oncoming gripper 10 and the transfer member 9 moves the sheet clockwise, as viewed in FIG. 2, whereby the sheet is completely withdrawn from the magazine by way of the respective outlet opening 4'. The gripper 10 opens as soon as the back 16*a* of the freshly withdrawn sheet 16 reaches the abutment 11 whereby the sheet begins to descend because its front edge portion 14 is engaged by the clamping device 13 substantially simultaneously with movement of the back 16*a* against the abutment 11. The clamping device 17 engages the other front edge portion 15 and the sheet 16 moves downwardly because the spreading members 12, 18 rotate in opposite directions. The clamping devices 13 and 17 release the sheet 16 before the edge portions 14, 15 respectively reach the guide faces 25, 24. However, since the spreading members 12, 18 rotate at a relatively high speed, the sheet 16 continues to open up (i.e., the distance between its front edge portions 14, 15 continues to increase) for a certain interval of time subsequent to disengagement of the clamping devices 13 and 17. Therefore, the edge portions 14, 15 move toward and engage the guide faces 25, 24. The streams of air which issue from the downwardly inclined orifices of the nozzles 26, 27 compel the front edge portions 15, 14 to move downwardly so that the front edge portions cannot advance at right angles to the adjacent portions 24', 25' of the guide faces 25, 24 (this could result in buckling of the front edge portions of the opened sheet 16). Instead, the front edge portions 14, 15 slide downwardly along the concave guide faces 25, 24. When the edge portions 14, 15 advance beyond the lower ends of the respective guide faces 25, 24, the air streams issuing from the orifices of the nozzles 26, 27 immediately accelerate the sheet 16 so that the latter rapidly descends onto the adjacent intercepting member 19 and remains thereon in an optimum position during arrival of the oncoming pusher 3 which transfers the sheet onto the upper reach 2*a*.

In order to insure that the uppermost sheet 16 of a pile of superimposed sheets on the upper reach 2*a* cannot change its position during rapid transport toward the next-following frame 1, the apparatus preferably further comprises means for biasing the uppermost sheet of each pile against the sheet therebelow. Such biasing means is shown in FIG. 1. It comprises one or more auxiliary or additional guide members 122, 123 which are mounted on suitable carriers (e.g., on the corresponding conduits 20, 21) between the frames 1 and have nozzles (not specifically shown) corresponding to the nozzles 26 and 27 of FIG. 2. The air streams issuing from the nozzles of the guide members 122, 123 (these guide members actually serve the sole purpose of holding the nozzles between the frames 1) urge the topmost sheets of successive piles of sheets against the sheets therebelow so that the position and/or orientation of sheets relative to the upper reach 2*a* remains unchanged while the piles advance from frame to frame. The nozzles of the guide members or holders 122, 123 further effect a desirable compacting of sheets in each pile. The provision of nozzles in the guide members or holders 122, 123 renders it possible to drive the conveyor 2 at an elevated speed and to thus increase the output of the gathering apparatus. In the absence of such nozzles, the uppermost sheets of successive piles would be likely to rise above the sheets therebelow or to move backwards as soon as the conveyor 2 is accelerated to a speed which is substantially less than the maximum speed commensurate with the ability of transfer members 9 and spreading members 12, 18 to deliver sheets onto the respective intercepting members.

A single conduit 20 can supply compressed air to the nozzles of all guide members 22, 122, and a single conduit 21 can supply compressed air to all guide members 23, 123. These conduits preferably serve as supports for the respective guide members.

In the appended claims, the terms "folded sheet" and "folded sheets" are intended to embrace discrete folded sheets or groups of folded sheets.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for gathering folded sheets of the type having a folded back and two front edge portions opposite the back, comprising a conveyor having an elongated portion moving in a predetermined direction; a plurality of magazines adjacent to said conveyor portion and spaced apart from each other, as considered in said direction, each magazine being arranged to store a supply of sheets; and discrete means for delivering sheets from each of said magazines to said conveyor portion, each of said delivering means including means for withdrawing sheets seriatim from the respective magazine in such orientation that the back of each withdrawn sheet is located at a level above the respective front edge portions and above said conveyor portion, spreading means for opening each withdrawn sheet including means for engaging the front edge portions, for moving the thus engaged front edge portions away from each other and for releasing the front edge portions before the respective sheet reaches said conveyor portion, and means to guide the opened sheet intermediate said spreading means and said conveyor portion, said guide means including first and second guide members disposed at opposite sides of a vertical plane passing through said elongated conveyor portion and having guide faces for engaging and guiding the respective released front edge portions of the opened sheet, each of said guide faces including at least two portions which diverge downwardly away from and at different angles to said vertical plane.

2. Apparatus as defined in claim 1, wherein said lower portions of said guide faces are disposed at the general level of said conveyor portion.

3. Apparatus as defined in claim 2, wherein said spreading means comprises two rotary speading members disposed at the opposite sides of said conveyor portion and each having one of said engaging means, said upper portions of said guide faces overlapping the respective spreading members.

4. Apparatus as defined in claim 1, further comprising means for biasing the opened sheets against said conveyor portion intermediate said magazines.

5. Apparatus as defined in claim 1, further comprising an intercepting member disposed between said conveyor portion and each of said spreading means to intercept successive opened sheets descending from the respective spreading means, said conveyor portion having entraining means arranged to strip opened sheets off said intercepting members.

6. Apparatus as defined in claim 1, wherein said conveyor is an endless flexible element having a substantially horizontal upper reach which constitutes said portion of said conveyor.

7. Apparatus for gathering folded sheets of the type having a folded back, comprising a conveyor having an elongated portion moving in a predetermined direction; a plurality of successive magazines adjacent to said conveyor portion and spaced apart from each other, as considered in said direction, each magazine being arranged to store a supply of sheets; discrete means for delivering sheets from successive magazines onto successive parts of said conveyor portion, including means for opening the sheets and for advancing the opened sheets to said parts of said conveyor portion in such orientation that opened sheets delivered from a preceding magazine are overlapped by opened sheets delivered from the next-following magazine whereby the overlapping and overlapped sheets on successive parts of said conveyor portion form a series of piles in each of which the back of the innermost sheet rides on said conveyor portion; and mechanical means for biasing the sheets against said conveyor portion intermediate said magazines.

8. Apparatus as defined in claim 7, wherein said biasing means comprises gas-discharging nozzles.

9. Apparatus as defined in claim 8, further comprising carrier means for said nozzles, said carrier means including means for supplying compressed gas to said nozzles.

10. Apparatus for gathering folded sheets of the type having a folded back, two front edge portions opposite the back and an outer side intermediate each edge portion and the back, comprising a conveyor having an elongated portion moving in a predetermined direction; a plurality of magazines adjacent to said conveyor portion and spaced apart from each other, as considered in said direction, each magazine being arranged to store a supply of sheets; and discrete means for delivering sheets from each of said magazines to said conveyor portion, each of said delivering means including means for withdrawing sheets seriatim from the respective magazine in such orientation that the back of each withdrawn sheet is located at a level above the respective front edge portions and above said conveyor portion, spreading means for opening each withdrawn sheet including means for temporarily engaging the front edge portions and for moving the thus engaged front edge portions away from each other, means to guide the opened sheet intermediate said spreading means and said conveyor portion, said guide means including first and second guide members disposed at the opposite sides of said conveyor portion and having guide faces for the respective front edge portions of the opened sheet, and means for promoting the downward movement of opened sheets toward said conveyor portion including means for discharging downwardly directed streams of a gaseous fluid against the other sides of successive opened sheets not later than while the edge portions of opened sheets travel along the respective guide faces.

11. Apparatus for gathering folded sheets of the type having a folded back, two front edge portions opposite the back and an outer side intermediate each edge portion and the back, comprising a conveyor having an elongated portion moving in a predetermined direction; a plurality of magazines adjacent to said conveyor portion and spaced apart from each other, as considered in said direction, each magazine being arranged to store a supply of sheets; and discrete means for delivering sheets from each of said magazines to said conveyor portion, each of said delivering means including means for withdrawing sheets seriatim from the respective magazine in such orientation that the back of each withdrawn sheet is located at a level above the respective front edge portions and above said conveyor portion, spreading means for opening each withdrawn sheet, said spreading means including two rotary spreading members disposed at the opposite sides of said conveyor portion and each having means for temporarily engaging the respective front edge portions of the withdrawn sheet and for moving the thus engaged front edge portions of the sheet away from each other, means to guide the opened sheet intermediate said spreading means and said conveyor portion, said guide means including first and second guide members disposed at the opposite sides of said conveyor portion and having guide faces for the respective front edge portions of the opened sheet, said guide faces having upper portions overlapping the respective speading members and lower portions disposed at the general level of said conveyor portion, and two nozzles having downwardly inclined orifices for discharging streams of a gaseous fluid against the outer sides of opened sheets, said orifices being provided in the upper portions of the guide faces of the respective guide members.

12. Apparatus for gathering folded sheets of the type having a folded back, two front edge portions opposite the back and an outer side intermediate each edge portion and the back, comprising a conveyor having an elongated portion moving in a predetermined direction; a plurality of magazines adjacent to said conveyor portion and spaced apart from each other, as considered in said direction, each magazine being arranged to store a supply of sheets; discrete means for delivering sheets from each of said magazines to said conveyor portion, each of said delivering means including means for withdrawing sheets seriatim from the respective magazine in such orientation that the back of each withdrawn sheet is located at a level above the respective front edge portions and above said conveyor portion, spreading means for opening each withdrawn sheet including means for temporarily engaging the front edge portions and for moving the thus engaged front edge portions away from each other, and means to guide the opened sheets intermediate said spreading means and said conveyor portion, said guide means including first and second guide members disposed at the opposite sides of said conveyor portion and having guide faces for the respective front edge portions of the opened sheet; and means for biasing the opened sheets against said conveyor portion intermediate said magazines, comprising pairs of nozzles disposed at the opposite sides of said conveyor portion and each having an orifice for directing a stream of gaseous fluid against the respective outer sides of successive topmost sheets on said conveyor portion.

13. Apparatus for gathering folded sheets of the type having a folded back, two front edge portions opposite the back and an outer side intermediate each edge portion and the back, comprising a conveyor having an elongated portion moving in a predetermined direction; a plurality of magazines adjacent to said conveyor portion and spaced apart from each other, as considered in said direction, each magazine being arranged to store a supply of sheets; and discrete means for delivering sheets from each of said magazines to said conveyor portion, each of said delivering means including means for withdrawing sheets seriatim from the respective magazine in such orientation that the back of each withdrawn sheet is located at a level above the respective front edge portion and above said conveyor portion, spreading means for opening each withdrawn sheet, and means for propelling the opened sheet toward said conveyor portion including means for discharging streams of a gaseous fluid against the outer sides of successive opened sheets in the general direction of said conveyor portion.

14. Apparatus as defined in claim 13, wherein each of said discharging means comprises discrete nozzles and further comprising means for supporting said nozzles in the proximity of the corresponding spreading means.

* * * * *